US007360810B2

(12) United States Patent
Dennis

(10) Patent No.: US 7,360,810 B2
(45) Date of Patent: Apr. 22, 2008

(54) ADJUSTABLE STRIKER FOR VEHICLE CLOSURE

(75) Inventor: Robert P. Dennis, Royal Oak, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/391,123

(22) Filed: Mar. 28, 2006

(65) Prior Publication Data

US 2007/0246955 A1 Oct. 25, 2007

(51) Int. Cl.
*E05C 21/02* (2006.01)

(52) U.S. Cl. ..... 292/341.18; 292/341.19; 292/340

(58) Field of Classification Search ..... 292/341.18, 292/341.19, DIG. 60
See application file for complete search history.

(56) References Cited

U.S. PATENT DOCUMENTS 2,019,408 A * 10/1935 Grill ..... 292/341.18
2,551,428 A * 5/1951 Englund et al. ..... 292/341.18
4,451,071 A * 5/1984 Striese et al. ..... 292/341.18
4,691,952 A * 9/1987 Harmon ..... 292/341.18
4,798,408 A * 1/1989 Harmon et al. ..... 292/341.18
4,906,037 A * 3/1990 Stammreich et al. .. 292/341.18
5,226,302 A * 7/1993 Anderson ..... 70/159
6,382,690 B1 * 5/2002 Dessenberger, Jr. .... 292/341.18
7,111,881 B2 * 9/2006 Paskonis ..... 292/340

* cited by examiner

*Primary Examiner*—Patricia Engle
*Assistant Examiner*—Kristina R Gluchowski

(57) ABSTRACT

The invention concerns an adjustable striker assembly for use with a closure for a vehicle compartment, and a method of forming such a striker assembly. A striker has a shaft with a hoop extending from one end, and engagement rings extending around the shaft, defining at least one gap between the engagement rings, and being canted relative to an axial direction of the shaft. The engagement rings may include a detent or a catch. The assembly also includes a bracket, which may be molded around the striker, that includes partial threads extending into at least one of the gaps, and flexing fingers that may operatively engage the detents or catches on the engagement rings.

14 Claims, 3 Drawing Sheets

ADJUSTABLE STRIKER FOR VEHICLE CLOSURE

BACKGROUND OF INVENTION

The present invention relates generally to a striker for a vehicle closure, and in particular to an adjustable striker assembly for engaging a latch on a compartment door, such as a glove box.

Closures in vehicles commonly have a latch and striker type of arrangement for holding the closure in its closed position. Often, the latch will be mounted to the closure with a button or other type of release mechanism controlling the latch. A striker is then mounted to a vehicle component or structure and located so the latch will engage the striker when the closure is moved to its fully closed position. The latch engagement with the striker then holds the closure in its closed position until the button is actuated to release the latch from the striker.

A common use for a latch and striker assembly is a vehicle glove box, with the latch mounted to the glove box door and the striker mounted to the glove box portion of an instrument panel. In modern vehicles, the styled surfaces of instrument panels typically do not provide natural overhangs or features that will hide improper door fit. Consequently, for proper aesthetics, automotive glove box doors are required to fit near perfectly on every vehicle. This is despite the fact that every instrument panel is installed into a vehicle body that has some variation due to manufacturing tolerances. When an instrument panel is installed into an automotive body, then, the fit of the glove box door may be changed, which may require adjustment to assure the latch and striker assembly engage properly.

Typical strikers used with glove box closures are made of bent steel wire, which is welded to a steel plate that is then riveted or screwed to the instrument panel. Many times the strikers are not precisely located when installed on the instrument panel—due to tolerances in locating the plate or twisting that may occur when mounting screws are tightened.

The need arises—whether due to instrument panel installation variations, striker installation variations, or both—to adjust the striker so the latch will engage with it when the glove box door is closed. Conventionally, this adjustment is accomplished by guessing what adjustment is needed and manually bending the wire of the striker. This is a very crude and inexact process that often results in the striker being bent and moved in unintended directions. The unwanted distortion from this crude adjustment process may increase the friction between the latch and striker and so may raise operating efforts—even possibly cause some binding in the latching assembly. Thus, the adjustment process, while assuring that the latch will engage the striker, may prevent the smooth operation of the latch and striker assembly.

It is desirable, therefore, to provide a striker that is used with a latch on a vehicle closure that allows for easy and accurate adjustment of the striker to assure that the latch and striker assembly works smoothly and properly.

SUMMARY OF INVENTION

An embodiment of the present invention contemplates an adjustable striker assembly for use with a closure for a vehicle compartment. The adjustable striker assembly may include a striker having a shaft with a first end and an opposed second end; a hoop extending from the first end; and a plurality of engagement rings extending around the shaft, defining at least one gap between the engagement rings, being canted relative to an axial direction of the shaft, and with each of the engagement rings including a pair of opposed first circumferential portions and a pair of opposed second circumferential portions, with the second circumferential portions extending radially outward farther from the shaft than the first circumferential portions. The adjustable striker assembly may also include a bracket having a main body adapted to be mounted to one of the closure and the compartment, a plurality of partial threads extending into at least one of the gaps, and a plurality of flexing fingers operatively engaging the engagement rings such that the flexing fingers are in a relaxed position when aligned with the second circumferential portions and are in a flexed position when not aligned with the second circumferential portions.

An embodiment of the present invention contemplates an adjustable striker assembly for use with a closure for a vehicle compartment. The adjustable striker assembly may include a striker having a shaft with a first end and an opposed second end, a hoop extending from the first end, and a plurality of engagement rings extending around the shaft, defining at least one gap between the engagement rings, being canted relative to an axial direction of the shaft, and at least one of the engagement rings including a catch; and a bracket having a main body adapted to be mounted to one of the closure and the compartment, a plurality of partial threads extending into at least one of the gaps, and a plurality of flexing fingers operatively engaging the engagement rings, with at least one of the flexing fingers including a barb receivable in the catch to thereby resist rotation of the striker relative to the bracket.

An embodiment according to the present invention may contemplate a method of forming an adjustable striker assembly that can be used with a closure for a vehicle compartment, the method comprising the steps of: forming a striker having a shaft with a first end and an opposed second end, and a plurality of engagement rings extending around the shaft, defining at least one gap between the engagement rings, being canted relative to an axial direction of the shaft, and with each of the engagement rings including a pair of detents; and insert molding a single piece bracket around the striker, including forming a plurality of partial threads extending into at least one of the gaps, and a plurality of flexing fingers operatively engaging the engagement rings such that the flexing fingers are in a relaxed position when aligned with the detents and are in a flexed position when not aligned with the detents.

An advantage of an embodiment of the present invention is that the adjustable striker assembly is relatively quick and easy to adjust to assure proper alignment with a corresponding latch.

An advantage of an embodiment of the present invention is that the adjustable striker assembly can be adjusted while minimizing the risk of damaging the striker, thus assuring smooth operation of the latch and striker assembly without increased friction or binding concerns.

An advantage of an embodiment of the present invention is that the adjustable striker assembly may not require assembly of separate components since the bracket body can be formed on the striker. With only two parts, the striker assembly is relatively simple and durable.

An advantage of an embodiment of the present invention is that the adjustable striker assembly can be adjusted without tools.

DETAILED DESCRIPTION

Figure 1:
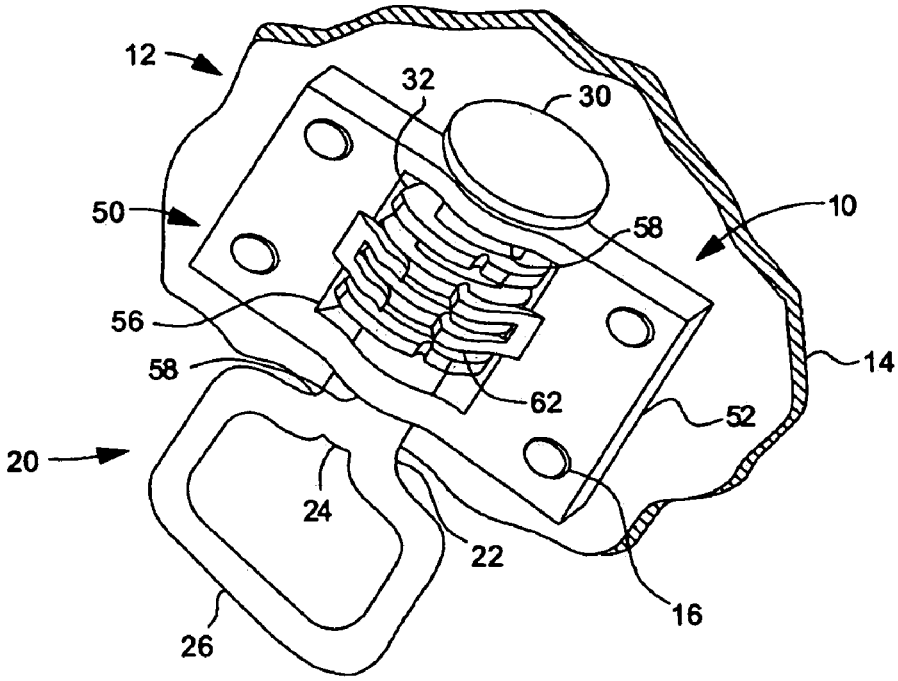
FIG. 1 is a somewhat schematic, perspective view of an adjustable striker assembly portion of a latch and striker assembly, in accordance with the present invention.
Figure 2:
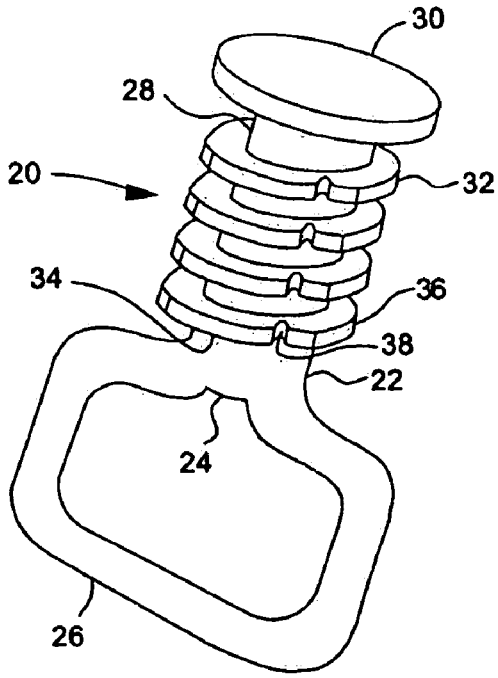
FIG. 2 is a somewhat schematic, perspective view of a striker portion of the adjustable striker assembly of FIG. 1.
Figure 3:
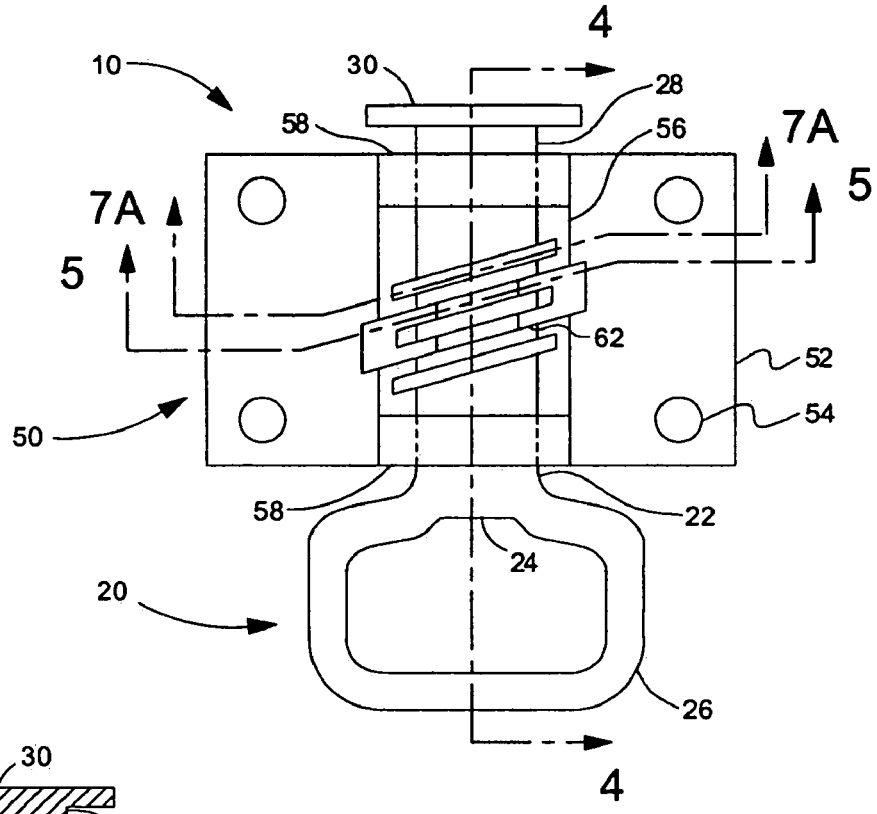
FIG. 3 is a somewhat schematic, plan view of the adjustable striker assembly of FIG. 1.
Figure 4:
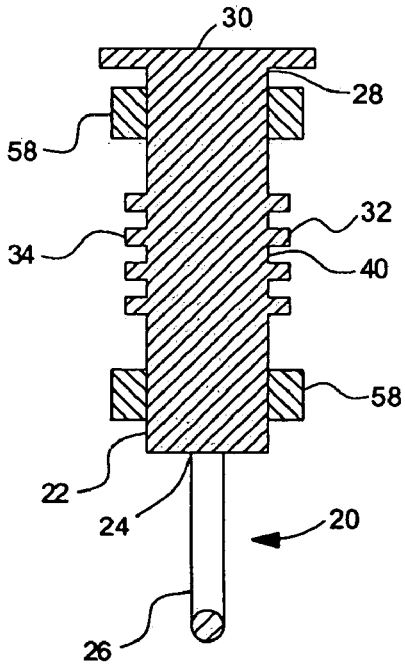
FIG. 4 is a section view taken along line 4-4 in FIG. 3.
Figure 5:
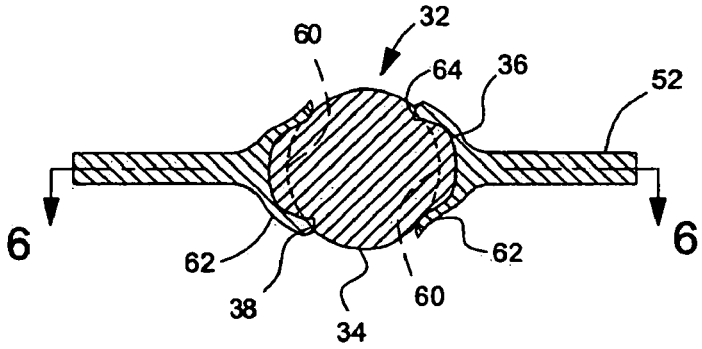
FIG. 5 is a section view taken along line 5-5 in FIG. 3.

FIGS. 1-7B illustrate an adjustable striker assembly, indicated generally at 10, which engages with a latch (not shown) of a latch and striker assembly, indicated generally at 12. The striker assembly 10 is mounted to one of a door or compartment 14 (only one of them shown in FIG. 1), with the latch being mounted to the other of the door or compartment. The striker assembly 10 may be secured to the door or compartment 14 with rivets 16 or other suitable fastening mechanisms. The compartment 14 may be, for example, a glove box opening in an instrument panel.

The striker assembly 10 includes a striker 20. The striker may be made of, for example, a metal such as steel, although other suitable materials may be employed instead. The striker 20 includes a generally cylindrical shaft 22, having a first end 24 from which a generally D-shaped hoop 26 extends, and a second end 28 from which an end cap 30 extends. The end cap 30 will resist impact loading, preventing the striker 20 from being pulled out of a bracket (discussed below) of the striker assembly 10. The hoop 26 may be formed into other shapes for engaging the striker, if so desired.

Extending around and radially outward from the shaft portion 22 are a set of generally circular engagement rings 32. The engagement rings 32 are spaced apart—forming gaps 40 between them—and canted relative to the shaft 22. Each engagement ring 32 includes, around its outer circumference, an opposed pair of first circumferential portions 34 and an opposed pair of second circumferential portions 36, with each portion 34, 36 extending roughly one quarter of the way around the shaft 22. The second circumferential portions 36 are located radially farther out from the central axis of the shaft than the first circumferential portions 34, and so, in effect, form detents on the rings 32. While having the second circumferential portions 36 located radially outward creates one type of detent, other types of detents that will selectively release the striker 20 from the bracket (discussed below) for rotation may be employed instead, if so desired.

Each engagement ring 32 may also have a pair of catches 38, which may be in opposed relationship and be located between the first and second circumferential portions 34, 36. The engagement rings 32 are each canted such that the opposed second circumferential portions 36 are offset axially by, for example, about one millimeter. The actual amount of the offset for a particular application depends upon the particular amount of desired adjustability.

The striker assembly 10 also includes a bracket, indicated generally at 50. The bracket 50 has a bracket body 52 with mounting holes 54 for receiving the fasteners 16 when securing the striker assembly 10 to the compartment 14. The bracket body 52 has a central opening 56 through which the striker 20 extends. Striker supports 58 surround and support the shaft 22 of the striker 20 at either end of the central opening 56—adjacent to the D-shaped hoop 26 and the end cap 30. The striker supports 58 are generally smooth and circular where they contact the shaft 22 of the striker 20. Thus, when the striker 20 is rotated relative to the bracket 50, these striker supports 58 allow rotation without significant resistance.

Figure 6:
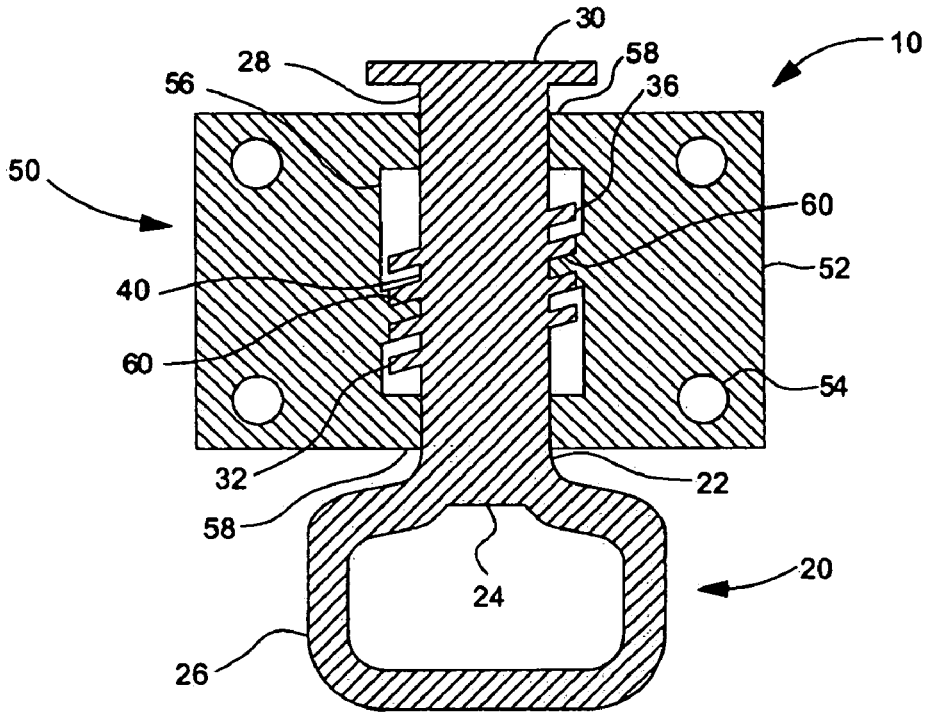
FIG. 6 is a section view taken along line 6-6 in FIG. 5.
Figure 7A:
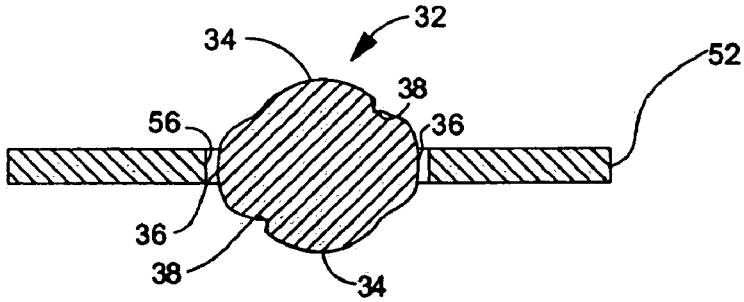
FIG. 7A is a section view taken along line 7A-7A in FIG. 3.
Figure 7B:
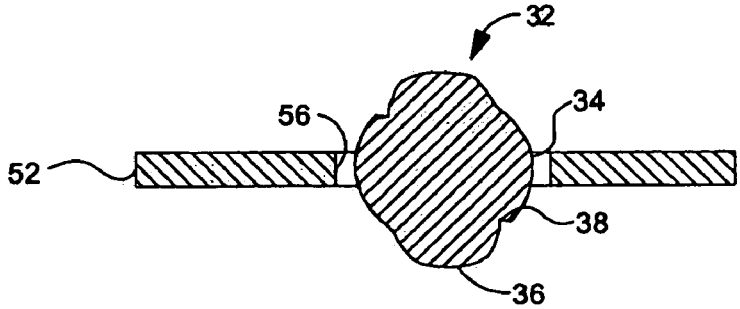
FIG. 7B is a view similar to FIG. 7A, but with the striker rotated ninety degrees to a striker release position.

The bracket 50 also has partial threads 60 extending from each side of the central opening 56 into one or more of the gaps 40 (only extending into one gap 40 in the embodiment shown in FIG. 6). These partial threads 60, being in the gap 40 (or gaps) between the engagement rings 32, cooperate with the engagement rings 32 to form, in effect, a partial threaded engagement. Extending on either side of the partial threads 60 (or interleaved with if additional partial threads are employed) are flexing fingers 62. Eight flexing fingers 62 are employed in this embodiment, although a greater or lesser number of fingers may be employed if so desired. The flexing fingers 62 extend over a portion of the outer radial surfaces of two of the engagement rings 32, and are sized to be relatively flexible. The flexing fingers 62 that extend adjacent to catches 38 on the engagement rings 32 include barbs 64 extending toward the catches 38. When the striker 20 is in a use position (the hoop 26 oriented parallel to the bracket body 52), the flexing fingers 62 are in a relaxed (i.e., not flexed) position and each barb 64 is seated in a corresponding catch 38. To put it another way, the curvature of the flexing fingers 62, in general, matches the curvature of the second circumferential portions 36.

The manufacturing of the striker assembly 10 may include the bracket 50 being formed around the striker 20, if so desired. For example, if the striker 20 is metal and the bracket 50 is plastic or some other similar, suitable material, then the striker 20 may be insert-molded into the bracket 50. The partial threads 60, then, would be formed when the material being molded flows into the gap 40 (or gaps) between the engagement ring 32 (or rings). The flexing fingers 62 are molded over the engagement rings 32 around the second circumferential portions 36. Accordingly, when the striker 20 is in the as-molded position (i.e., with the hoop 26 parallel to the bracket body 52), the flexing fingers 62 are also in as-molded positions, and so are not flexed. The flexing fingers 62 are thus in a non-stressed configuration as manufactured and when the striker 20 is in its use-position. The bracket body 52 and striker supports 58 can also be molded at the same time. This particular manufacturing process is advantageous in that it creates a two piece adjustable striker assembly 10 that does not require assembly after forming, while still allowing for adjustment between the D-shaped hoop 26 that engages the latch (not shown) and the mounting holes 54 where the striker assembly 10 is mounted to the door or compartment 14. So, by forming the bracket 50 this way, it can be a single monolithic piece.

While the insert molding of a plastic bracket 50 around a metal striker 20 is a preferred method, other materials may be used and other fabrication and assembly methods may be employed instead, if so desired. For example, the bracket and striker may both be made of metal and/or the bracket formed in multiple pieces that are assembled to the striker.

The installation and adjustment of the adjustable striker assembly 10 will now be described. The bracket body 52 is placed in the desired location of the door or compartment 14, as the case may be, and the fasteners 16 are installed through the mounting holes 54 to secure the striker assembly in place. If the D-shaped hoop 26 is in the proper location for engagement with the latch, then no further adjustment needs to be made. If the D-shaped hoop 26 does not engage properly with the latch, then the hoop 26 is grasped and rotated one-half turn relative to the bracket 50. Since the engagement rings 32 are canted relative to the shaft 22, and the partial threads 60 are relatively stiff, the one-half turn will move the hoop 26 away from the bracket 50 by the amount of pitch in the engagement rings 32.

In order to assure that once the proper alignment is attained the striker 20 will remain in the desired position during repeated use of the latch and striker assembly 12, rotation can only be accomplished when significant torque is applied. The torque that resists this rotation is created by the interaction of the second circumferential portions 36 with the flexing fingers 62 and the barbs 64 with the catches 38. In other words, during this rotation, enough torque must be applied to initially pull the barbs 64 out of the catches 38. Then, as the striker 20 is part way through the one-half turn, enough torque must be applied to allow the flexing fingers 62 to be flexed outward by the second circumferential portions 36 (since they are radially out farther than the first circumferential portions 34). When the adjustment is completed—at one-half turn—the barbs 64 will again be aligned with catches 38, and the second circumferential portions 36 will again be aligned between the flexing fingers 62, so the flexing fingers 62 will return to their non-stressed positions. The amount of torque required to cause rotation of the striker 20 relative to the bracket 50 may be easily tuned by making small changes to the thickness of the flexing fingers 62 and/or changes to the catches 38 and barbs 64.

While certain embodiments of the present invention have been described in detail, those familiar with the art to which this invention relates will recognize various alternative designs and embodiments for practicing the invention as defined by the following claims.

What is claimed is:

1. An adjustable striker assembly for use with a closure for a vehicle compartment, the adjustable striker assembly comprising:

a striker having a shaft with a first end and an opposed second end; a hoop extending from the first end; and a plurality of engagement rings extending around the shaft, defining at least one gap between the engagement rings, being canted relative to an axial direction of the shaft, and with each of the engagement rings including a pair of opposed first circumferential portions and a pair of opposed second circumferential portions, the second circumferential portions extending radially outward farther from the shaft than the first circumferential portions; and a bracket having a main body adapted to be mounted to one of the closure and the compartment, a plurality of partial threads extending into at least one of the gaps, and a plurality of flexing fingers operatively engaging the engagement rings such that the flexing fingers are in a relaxed position when aligned with the second circumferential portions when the striker is in a use position and are in a flexed position when not aligned with the second circumferential portions, when the striker is in a release position, wherein at least one of the engagement rings includes a catch, and at least one of the flexing fingers includes a barb selectively receivable in the catch.

2. The adjustable striker assembly of claim 1 wherein the striker has an end cap located at its second end and adapted to prevent the striker from pulling out of the bracket.

3. The adjustable striker assembly of claim 1 wherein the main body includes a plurality of mounting holes adapted to receive fasteners for attaching the striker assembly to one of the closure and the compartment.

4. The adjustable striker assembly of claim 1 wherein the plurality of engagement rings comprises four engagement rings and the plurality of flexing fingers comprises eight flexing fingers.

5. The adjustable striker assembly of claim 1 wherein the plurality of partial threads comprises two partial threads.

6. The adjustable striker assembly of claim 1 wherein the bracket includes a first striker support adjacent to the first end and a second striker support adjacent to the second end, with the first and second striker supports supporting the shaft while allowing the shaft to selectively rotate relative to the bracket.

7. The adjustable striker assembly of claim 1 wherein the striker is made of a metal and the bracket is made of a plastic.

8. The adjustable striker assembly of claim 7 wherein the bracket is a single monolithic piece.

9. An adjustable striker assembly for use with a closure for a vehicle compartment, the adjustable striker assembly comprising:

a striker having a shaft with a first end and an opposed second end; a hoop extending from the first end; and a plurality of engagement rings extending around the shaft, defining at least one gap between the engagement rings, being canted relative to an axial direction of the shaft, and at least one of the engagement rings including a catch; and a bracket having a main body adapted to be mounted to one of the closure and the compartment, a plurality of partial threads extending into at least one of the gaps, and a plurality of flexing fingers operatively engaging the engagement rings, such that the flexing fingers are in a relaxed position when aligned with the second circumferential portions when the striker is in a use position and are in a flexed position when not aligned with the second circumferential position when the striker is in a release position, with at least one of the flexing fingers including a barb receivable in the catch to thereby resist rotation of the striker relative to the bracket.

10. The adjustable striker assembly of claim 9 wherein the plurality of flexing fingers is eight flexing fingers and at least four of the eight flexing fingers include a barb extending therefrom, and wherein at least two of the engagement rings include a pair of opposed catches engageable with the barbs to thereby resist rotation of the striker relative to the bracket.

11. The adjustable striker assembly of claim 9 wherein the plurality of engagement rings comprises four engagement rings.

12. The adjustable striker assembly of claim 9 wherein the plurality of partial threads comprises two partial threads.

13. The adjustable striker assembly of claim 9 wherein the bracket is a single monolithic piece.

14. The adjustable striker assembly of claim 9 wherein the bracket includes a first striker support adjacent to the first end and a second striker support adjacent to the second end, with the first and second striker supports supporting the shaft while allowing the shaft to selectively rotate relative to the bracket.

* * * * *